US005862193A

United States Patent [19]

Jia et al.

[11] Patent Number: 5,862,193

[45] Date of Patent: Jan. 19, 1999

[54] PRODUCTION OF $^{186}$RE, $^{188}$RE AND OTHER RADIONUCLIDES VIA INORGANIC SZILARD-CHALMERS PROCESS

[75] Inventors: Wei Jia; Gary J. Ehrhardt, both of Columbia, Mo.

[73] Assignee: The Curators of the University of Missouri, Columbia, Mo.

[21] Appl. No.: 915,126

[22] Filed: Aug. 20, 1997

[51] Int. Cl.$^{6}$ ..... G21G 1/00

[52] U.S. Cl. ..... 376/158; 376/189

[58] Field of Search ..... 376/158, 189; 423/2, 49; 250/432 PD

[56] References Cited

U.S. PATENT DOCUMENTS

| | | | |
|---|---|---|---|
| 5,053,186 | 10/1991 | Vanderheyden et al. | 376/189 |
| 5,145,636 | 9/1992 | Vanderheyden et al. | 376/189 |
| 5,382,388 | 1/1995 | Ehrhardt et al. | 252/635 |

OTHER PUBLICATIONS

W. Jia et al. "The Production of very High Specific Activity re–186 Using an Inorganic Szilard Chalmers Process" Abstr. No. 057, Abstract of Papers, 212th American Chemical Society National Meeting, Orlando Florida, Aug. 25–29, 1996.

Z. Zhang et al. "Production of 186Re in High Specific Activity for Radioimmunotherapeutic Use By The Szilard–Chalmers Reaction" Abstr. No. 058, Abstract of Papers, 212th American Chemical Society National Meeting, Orlando Florida, Aug. 25–29, 1996.

W Jia et al. "Progress Toward Enhanced Specific Activity Re–186 Using Inorganic Szilard–Chalmers Methods" Technetium & Renium In Chemistry and Nuclear Medicine 4, Proceedings of the fourth International Symposium on Technetium in Chemistry and Nuclear Medicine, Seminario Maggiore, Bressanone, Italy (Sep. 12–14, 1994) pp. 379–381.

P. Schubiger et al. "Production of 186Re With High Specific Activity by the Szilard–Chalmers Reaction" Technical University of Munich, Munich, Germany, 1995.

*Primary Examiner*—Charles T. Jordan
*Assistant Examiner*—Matthew J. Lattig
*Attorney, Agent, or Firm*—Senniger, Powers, Leavitt & Roedel

[57] ABSTRACT

Methods for the production of radionuclides suitable for use in radiopharmaceuticals for diagnostic and therapeutic applications, and specifically, to the production of $^{186}$Re, $^{188}$Re and other radionuclides such as $^{195m}$Pt and $^{198}$Au using an inorganic Szilard-Chalmers reaction. Thin-film and powdered $^{185or187}$ Re° metal targets, and $^{185or187}$ Re oxide/metal oxide target compositions with rhenium in a lower, relatively reduced oxidation state are prepared. The thin-film rhenium targets are aged for at least about 24 hours and then irradiated with neutrons in the present of an oxidizing medium sufficient to form a product nuclide in the higher oxidized state of perrhenate, $ReO_4^-$. Significantly, the rate and/or extent of oxidation of target nuclides which do not react with a neutron is controlled. For example, oxidation of such non-bombarded target nuclides is minimized by irradiating under vacuum, controlling the amount of oxidizing agent present, cooling during irradiation, etc. The product nuclide is recovered by dissolving the perrhenate in a non-oxidizing solvent such as water or saline.

45 Claims, 1 Drawing Sheet

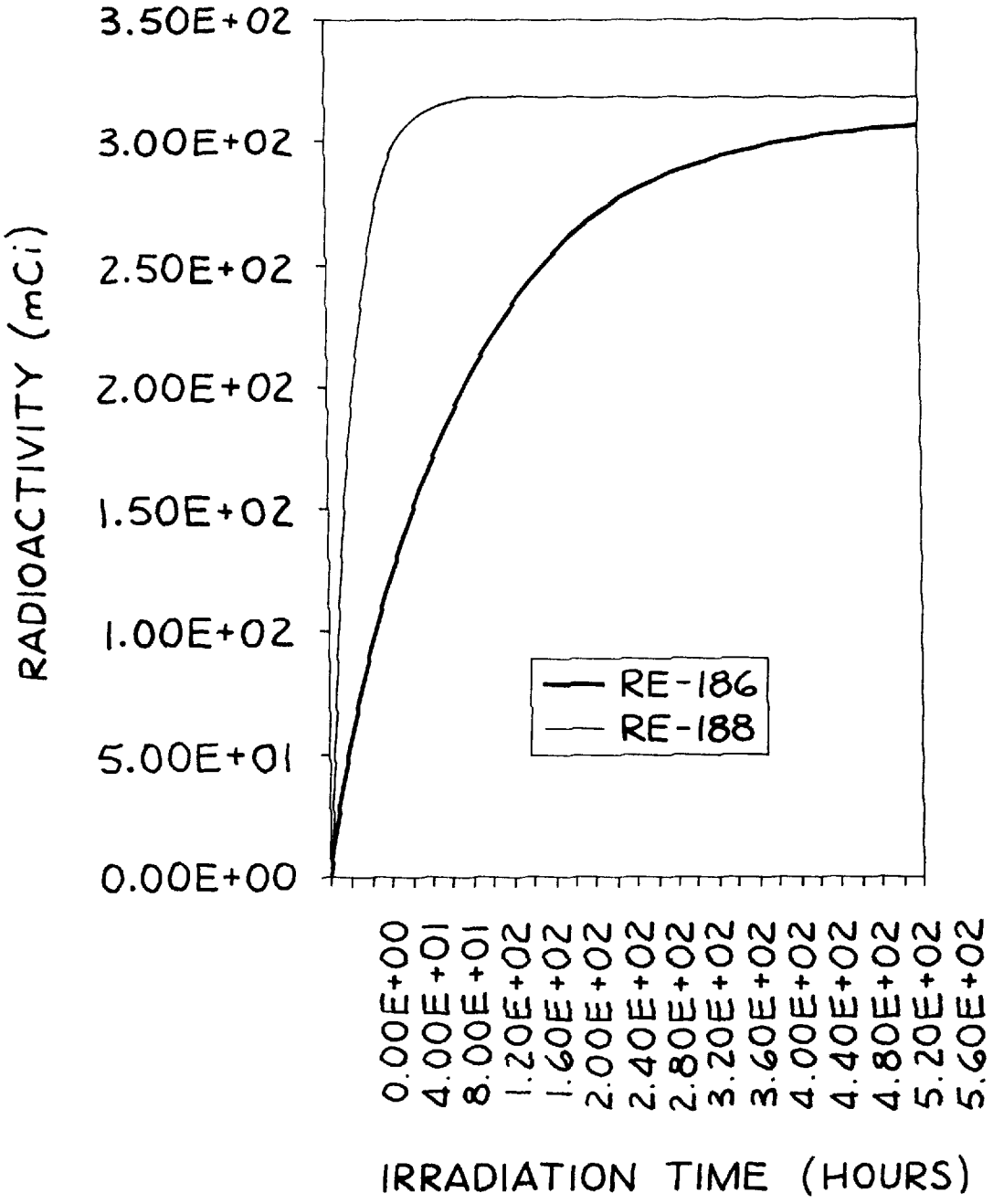
3.50E+02
3.00E+02
2.50E+02
2.00E+02
1.50E+02
1.00E+02
5.00E+01
0.00E+00
RADIOACTIVITY (mCi)
RE-186
RE-188
0.00E+00
4.00E+01
8.00E+01
1.20E+02
1.60E+02
2.00E+02
2.40E+02
2.80E+02
3.20E+02
3.60E+02
4.00E+02
4.40E+02
4.80E+02
5.20E+02
5.60E+02
IRRADIATION TIME (HOURS)

PRODUCTION OF $^{186}$RE, $^{188}$RE AND OTHER RADIONUCLIDES VIA INORGANIC SZILARD-CHALMERS PROCESS

BACKGROUND OF THE INVENTION

This application claims priority to U.S. provisional patent application Ser. No. 60/024,551 filed Aug. 26, 1996. The invention generally relates to the production of radionuclides for diagnostic and therapeutic use, and specifically, to the production of $^{186}$Re, $^{188}$Re and other radionuclides using an inorganic Szilard-Chalmers reaction.

For a number of years, isotopes of rhenium, particularly $^{186}$Re and $^{188}$Re, have been of interest to the nuclear medicine community for use in therapeutic applications. Both $^{186}$Re and $^{188}$Re are beta-emitting radionuclides with relatively short half lives of 90 hours and 17 hours, respectively. The maximum beta energy of $^{186}$Re is 1.07 MeV, while that of $^{186}$Re is 2.12 MeV. In addition, both isotopes exhibit gamma emissions (9.2%, 137 keV and 15%, 155 keV, respectively) suitable for evaluation of in vivo distribution of rhenium agents. Recent measurements of $^{186}$Re by the National Institute of Standards and Technology (Coursey et al., Appl. Radiat. Isot. Vol. 42, No. 9, 865, 1991) showed that the decay half-life of $^{186}$Re is 89.25±0.07 hours and that the probability of emission of the principal gamma ray at 137keV was 0.0945±0.0016. The beta emission at 1.077MeV is 71.4% abundant, the emission at 0.94 MeV contributes 21.3%, and 7.28% by electron capture.

Major areas of interest for $^{186}$Re and $^{188}$Re include: radiolabeled monoclonal antibodies (Su et al., J. Nucl. Med. Abstr. 484 31, 823, 1990; DiZio et al., Bioconjugate Chem 2, 353, 1991; Weiden et al., Radiopharm 5, 141, 1992); lung and colon carcinomas (Schroff et al., Immunoconjugates Radio-pharmaceuticals 3, 99, 1990); labeled progestin conjugates for possible treatment of steroid receptor-positive tumors (DiZio et al., J. Nucl. Med. Vol. 33, No. 4, 558, 1992); labeled phosphonate complexes ($^{186}$Re-HEDP) for relief of pain associated with metastatic bone cancer (Pipes et al., J. Nucl. Med. Abstr. 254, 31, 768, 1990); and labeled dimercaptosuccininic acid ($^{186}$Re-DMSA) for tumors of the head and neck (Bisunadan et al., Appl. Radiat. Isot. 42, 167, 1991). Recently, Ehrhardt et al. evaluated the formulation of $^{186}$Re labeled human serum albumin microspheres in an animal model as a potential radiation synovectomy agent Rhenium-186 labeled hydroxyapatite particles are also being evaluated as a potential radiopharmaceutical for radiation synovectomy (Chinol et al., J. Nucl. Med., 34: 1536, 1993; Clunie et al., Nucl. Med., 36: 51, 1995).

$^{186}$Re and $^{188}$Re can be produced via a (n,γ) reaction from $^{185}$Re and $^{187}$Re target nuclides, respectively. According to one approach, a $^{185}$Re target nuclide—present either as a thick metal target of isotopically enriched elemental $^{185}$Re (95%) or as a water soluble perrhenate salt (e.g. aluminum perrhenate, $Al(^{185}ReO_4)_3$)—is irradiated with thermal neutrons at a flux of about $10^{13}$–$10^{15}$ n/cm$^2$s to form a product $^{186}$Re nuclide. When a elemental rhenium target is employed, the product nuclide is recovered by oxidizing the rhenium metal with an oxidizing solvent such as $H_2O_2$ or nitric acid to obtain a soluble perrhenate solution which includes the product nuclide. When a perrhenate salt target is employed, the product nuclide is recovered by dissolving the irradiated perrhenate target in water or saline solution (Ehrhardt et al., US Pat. No. 5,053,186). However, it would be beneficial to improve the specific activity of the $^{186}$Re formed via such conventional (n,γ) approaches. Although the thermal and epithermal neutron cross-sections for Re-185 are high (106 b and 1632 b, respectively), the specific activity of $^{186}$6Re produced using conventional (n,γ) methods in a reactor such as the Missouri University Research Reactor, MURR, with a thermal neutron flux $4.5\times10^{14}$ n/cm$^2$s, is only about 3 Ci/mg Re. Since only a handful of reactors with higher neutron fluxes are operating in the world, using a higher neutron flux to enhance the specific activity of $^{186}$Re is not a viable commercial alternative.

Another approach for producing $^{186}$Re and $^{188}$Re via a (n,γ) reaction involves the use of a Szilard-Chalmers reaction, in which the chemical and/or physical changes to a nuclide that result from a neutron-capture reaction are employed advantageously. The study of the chemical behavior of high energy atoms produced from nuclear reactions and/or radioactive decay processes, typically referred to as "hot atom" chemistry, was initiated in 1934 by L. Szilard and T. A. Chalmers, who demonstrated that after ethyl iodide was irradiated by thermal neutrons, some of the radioactive I-128 could be extracted from the ethyl iodide by water. (Szilard and Chalmers, Nature, 134, 462, 1934). According to most known Szilard-Chalmers techniques for producing $^{186}$Re and/or $^{188}$Re, an organic-Re complex is used as the starting material, and the ~6 MeV of excitation gamma energy emitted by the rhenium nucleus after thermal neutron capture (ie., recoil energy) ruptures the organometallic bonds. Schubiger et al. (Technical University of Munich, Munich, Germany, 1995) reported irradiating a rhenium compound, $Cp^*ReO_3$ (pentamethyl cyclopentadienyl rheniumtrioxide), and observed that the activated compounds containing hot Re atoms decomposed to water soluble perrhenate while the rest of the molecules would remain in the organic phase. The specific activity of $^{186}$Re was, in this case, reported as being enhanced by a factor between 400–800 with neutron irradiation at $1.5\times10^{13}$ n/cm$^2$s for 10 minutes. Zhang et al. reported a similar approach. (Zhang et al., Abstracts of Papers, Part I, 212th ACS National Meeting of the American Chemical Society, 1996). However, Szilard-Chalmers reactions normally do not result in significant specific activity enhancement in high neutron fluxes during longer periods of irradiation due to the increased radioactive (gamma and fast-neutron) decomposition of non-activated metal-organic bonds. In other words, experiments using organic compounds frequently produce large enhancement of specific activity for short irradiations in low neutron fluxes, but progressively fail to deliver enhanced specific activity product as irradiation time and neutron flux are increased.

SUMMARY OF THE INVENTION

It is therefore an object of the present invention to produce $^{186}$Re, $^{188}$Re and other pharmaceutically useful radionuclides in commercially significant yields and at clinically significant specific activities. It is also an object of the invention to produce such radionuclides using methods and reagents which are commercially attractive.

Briefly, therefore, the present invention is directed to a method for producing a radionuclide via a (n,γ) Szilard-Chalmers reaction. The method generally comprises irradiating a target with neutrons in the presence of an oxidizing agent to form an irradiated mixture. The target comprises a metal target nuclide, such as a rhenium nuclide, in the form of a metallic element or an inorganic metallic compound or salt. The resulting irradiated mixture comprises (a) an oxidized product nuclide formed by reaction of the target nuclide with neutrons via a (n,γ) reaction and with the oxidizing agent via an oxidation reaction, and (b) unreacted target nuclide which has not reacted with a neutron or with the oxidizing agent. The irradiated mixture may also include, but preferably to a minimal extent, target nuclide which has not reacted with a neutron, but which has, nonetheless, been oxidized. The irradiated mixture is then processed to separate the oxidized product nuclide from unreacted target nuclide. According to one aspect of the method, the rate and/or extent of oxidation of target nuclide which has not reacted with a neutron is controlled in a manner to minimize oxidation of such target nuclide. According to another aspect of the method, the amount of oxidizing agent present during irradiation ranging from a stoichiometric amount to about four times the stoichiometric amount required for the target nuclide to react with the oxidizing agent to form the oxidized product nuclide. According to an additional aspect of the method, the target is irradiated with neutrons at a pressure which is less than atmospheric pressure. According to a further aspect of the method, the target is cooled while the target is being irradiated. According to yet another aspect of the method, the metal target nuclide is present in a target layer formed on the surface of a substrate, where the target layer comprises a metallic element or an inorganic metallic compound or salt and has a projected thickness of not more than about 150 nm. The oxidized product nuclide is then separated from unreacted target nuclide by a protocol which includes the step of exposing the oxidized product nuclides to a non-oxidizing solvent. In what is yet a further aspect of the method, the target is prepared and then allowed to age for at least about 24 hours before it is irradiated with neutrons. The several aspects of the method may be employed independently, or in combination with each other.

The invention is also directed to a method for producing $^{186}$Re or $^{188}$Re via a (n,γ) Szilard-Chalmers reaction. In this method, a target is prepared which comprises a rhenium target nuclide, $^{t}$Re, having an oxidation state of not more than $^{+}$6. The rhenium target nuclide is present in the target in the form of elemental rhenium or an inorganic rhenium compound or salt. As used in $^{t}$Re, t is 185 for producing $^{186}$Re and t is 187 for producing $^{188}$Re. The prepared target is allowed to age for at least about 24 hours, and is then irradiated with neutrons at a pressure which is less than atmospheric pressure and in the presence of an oxidizing agent for at least about 1 hour to form an irradiated mixture. The irradiated mixture comprises (a) an oxidized product nuclide, $^{p}$Re, formed by reaction of $^{t}$Re with neutrons via a (n,γ) reaction and with the oxidizing agent via an oxidation reaction, where p is 186 when t is 185 and where p is 188 when t is 187, and (b) unreacted target nuclide which has not reacted with a neutron or with the oxidizing agent. The target is cooled while being irradiated. The irradiated mixture is then processed and/or treated to separate the oxidized product nuclide from unreacted target nuclide and to, thereby, form a product mixture. The product mixture is isotopically enriched in the product nuclide by a factor of at least about 1.5 relative to the irradiated mixture.

The invention is additionally directed to a solid target suitable for use in producing $^{186}$Re or $^{188}$Re via a (n,γ) Szilard-Chalmers reaction. The target comprises, in one embodiment, a target layer formed on a surface of a substrate. The target layer comprises an inorganic rhenium compound or salt and having a projected thickness of not more than about 150 nm. In another embodiment, the target comprises granules of an inorganic rhenium compound or salt having an average radius of less than about 150 nm (1500 Å). In either of the immediately aforementioned embodiments, the compound or salt includes a $^{t}$Re target nuclide in an oxidation state of not more than +6, where t is 185 for producing $^{186}$Re or 187 for producing $^{188}$Re.

The present invention offers substantial advantages over prior art approaches for producing radionuclides via Szilard-Chalmers reactions. The claimed methods result in improved specific activities for radionuclides such as $^{186}$Re and $^{188}$Re produced by (n,γ) reactions. Importantly, such improvements are realized using safe, stable non-organometallic targets. Moreover, the radionuclide of interest can be separated from unreacted target nuclides using simple, commercially attractive reagents.

While the invention is described below particularly with respect to the production of $^{186}$Re, such detailed discussion should be considered exemplary and non-limiting. The methods of the present invention are applicable to the production of other radionuclides, including for example $^{188}$Re, $^{195m}$Pt or $^{198}$Au. Other features and objects of the present invention will be in part apparent to those skilled in the art and in part pointed out hereinafter.

BRIEF DESCRIPTION OF THE DRAWINGS

FIG. 1 is a plot of the radioactivity versus irradiation time for the production of $^{186}$Re and $^{188}$Re at a thermal neutron flux of $7\times10^{13}$ n/cm$^2$s using 1 mg of natural rhenium in a thin-film target.

The invention is described in further detail below with reference to the figure.

DETAILED DESCRIPTION OF THE INVENTION

According to the present invention, a metal target nuclide is irradiated with neutrons in the presence of an oxidizing agent to form an oxidized product nuclide which is capable of dissolving in a non-oxidizing solvent. Without being bound by theory, the neutron-capture reaction and subsequent recoil reaction (about 6 MeV gamma energy), provide sufficient activation energy to yield transient temperatures of many thousands of degrees Kelvin and, therefore, to facilitate oxidation of the product nuclide. Significantly, oxidation of target nuclide which does not react with neutrons is controlled to minimize the rate and/or extent of such oxidation reaction. Specifically, the reaction conditions such as the amount of oxidizing agent and temperature are maintained to minimize oxidation of target nuclides which are not bombarded with neutrons and/or do not otherwise participate in the neutron-capture/recoil reactions. The oxidized product nuclide is then separated from unreacted target nuclide based on their difference in oxidation states. After separation, the specific activity of the separated product nuclide is enhanced.

The target nuclide is a metal atom in a first lower (ie, relatively reduced) oxidation state, and is capable of reacting with a neutron via a (n,γ) reaction and with an oxidizing agent via an oxidation reaction to form a product nuclide in a higher oxidation state. The metal target nuclide is preferably in its ground state energy level before being bombarded with neutrons. $^{185}$Re, $^{187}$Re, $^{194}$Pt or $^{197}$Au are preferred target nuclides. However, other nuclides suitable for use with the present invention will be apparent to those skilled in the art. While many of the details presented herein will pertain to $^{186}$Re production from a $^{185}$Re target nuclide, such details and teachings are considered exemplary and will apply equally to the production of $^{188}$Re and other radionuclides of interest.

The metal target nuclide is present in a target as a metallic element or an inorganic metallic compound or salt.

Significantly, the metal target nuclide is not chemically bonded, complexed or otherwise associated with an organic species or moiety. Organo-metallic target materials are excluded from the (n,γ) reaction because they tend to decompose into a gaseous state during long periods of irradiation and/or at a high neutron flux. In contrast, metallic elements and/or inorganic metallic compounds or salts can be safely irradiated for relatively longer periods of time and at relatively higher neutron fluxes, thereby allowing for the production of radionuclides by Szilard-Chalmers type reactions having enhanced specific activities.

For the production of $^{186}$Re and/or $^{188}$Re from a rhenium target nuclide, $^{t}$Re, where t is 185 for producing $^{186}$Re and t is 187 for producing $^{188}$Re, the target comprises, and more preferably, consists essentially of elemental rhenium, an inorganic rhenium compound or a salt thereof. The $^{185}$Re or $^{187}$Re target nuclide has an oxidation state which is not more than $^{+}6$, and can range from 0 (corresponding to elemental Re and designated herein as $Re^{o}$) to $^{+}6$. The oxidation state of such rhenium nuclides is more preferably 0 ($Re^{o}$), or ranging from +3 ($^{t}Re^{+3}$) to +6 ($^{t}Re^{+6}$), and most preferably selected from the oxidation states of 0, $^{+}4$ or $^{+}6$. As discussed below, a variety of target formats are suitable for use with the present invention.

The target nuclide is, in one embodiment, present in a target as a thin metal film. Such a target comprises a target layer comprising an elemental metal formed on a surface of a substrate. For $^{186}$Re production, the target layer comprises $^{185}Re^{o}$. (See, for example, Example 1). While natural rhenium, having about 37.4% $^{185}$Re and about 62.6% $^{187}$Re can be used, the target layer preferably consists essentially of enriched $^{185}$Re, preferably $^{185}$Re which is at least about 95% enriched. The target layer has a projected thickness which is sufficiently thin to allow for improved recovery of the product nuclide. The projected thickness is preferably less than about 1.5 μm, more preferably less than about 150 nm (about 1500 Å), and even more preferably about 15 nm (150 Å). The projected thickness is preferably greater than about 1.5 nm (about 15 Å). Without being bound by theory, thinner target layers allow for irradiation of and subsequent dissolution of a relatively larger amount of product nuclide, thereby improving the overall recovery or yield. The geometry (shape, size, etc.) of the target layer are not critical, but a larger surface area is generally preferred to maximize the production yield.

The substrate preferably consists essentially of a high-purity material having a melting point which is higher than the temperature to which the substrate is exposed during irradiation. Additionally, the substrate is preferably a material which, upon irradiation, either does not form radioactive isotopes, or if radioactive isotopes are formed, the isotopes have a half life which is less than about 10 hours, more preferably less than about 5 hours and most preferably less than about 2 hours. The substrate should also have sufficient strength to adequately support the thin metal film during film preparation and irradiation. Moreover, the substrate should be inert with respect to allowing subsequent separation of the product nuclide. Quartz ($SiO_2$) is a preferred substrate. The geometry of the substrate is not narrowly critical. The substrate can have a dual functionality which includes for example, in addition to supporting the thin metal film, acting as the irradiation can or chamber such that it forms the pressure boundary for a irradiating under vacuum.

The thin metal target can be prepared by chemical vapor deposition (CVD) methods generally known in the art. For rhenium thin-film targets, thermal decomposition of rhenium halides such as $ReCl_3$ and $ReCl_5$ at temperatures ranging from about 700° C. to about 1000° C. may be used (See, for example, Example 1). A vacuum is preferably drawn in the deposition chamber while the film is being deposited, whereby organic impurities, volatile rhenium chlorides, water and/or other impurities are removed. The rhenium targets prepared under vacuum appear to be more stable upon irradiation and result in higher radioisotope enrichment factors. Rhenium forms on the substrate surface as a silvery metal. Other methods for preparing the thin-film on the substrate, including electroplating, may also be used for some systems. After formation, the rhenium film is preferably washed using a non-oxidizing solvent such as water or acetone to remove residual rhenium chloride and/or perrhenate. The film is then vacuum dried for a period ranging from several hours up to about 24 hours. After drying, the thin film targets are, as discussed in detail below, preferably stored for a period of time prior to being used for radionuclide production.

In an alternative target, powered granules of the elemental metal (e.g. rhenium) having a diameter of less than 1.5 μm, and preferably less than about 150 nm (1500 Å) can be used. (See, for example, Example 2). The powdered granules preferably consist essentially of the elemental metal. When $^{185}$Re is the target nuclide, the granules preferably consist essentially of $^{185}$Re enriched to at least about 95%. Such finely powdered targets provide for improved surface area and ultimately, improved yield of the product nuclide by allowing a greater fraction of the radioactive perrhenate to be recovered.

In another embodiment, the target nuclide can be present in the target as an inorganic compound (e.g. hydrated $Re_2S$, $ReSi_2$, or inorganic oxides such as $ReO_2$, $ReO_3$) or an inorganic salt (e.g. $MgReO_4$) in a less-than-fully oxidized state. When the target nuclide is rhenium, preferred inorganic rhenium compounds include rhenium oxides ($^{185}ReO_x$ or $^{187}ReO_x$ where x is 2 or 3) or an inorganic salt comprising a rhenium oxide ($^{185}ReO_x$ or $^{187}ReO_x$ where x ranges from 2 to 4). The target can, moreover, comprise a target composition which includes a solid mixture of rhenium oxide in combination with a metal oxide or with a metal hydroxide, designated herein as M-oxide or M-hydroxide where M is a metal other than rhenium. (See, for example, Example 3). Preferably, $ReO_2$ or $ReO_3$ are combined with metal oxides or metal hydroxides. The metal used is not narrowly critical, but is preferably an inert metal other than rhenium which either does not produce a radioisotope upon subsequent irradiation, or if a radioisotope is produced, the half-life of any such metal isotope is relatively short compared to the half-life of the radionuclide of interest. For rhenium production, the half-life of any such metal isotope is preferably less than 10 hours, more preferably less than 5 hours and most preferably less than 2 hours. The metal should be inert with respect to the separation effected after irradiation. In the preferred process, the oxide of the metal should be insoluble in non-oxidizing solvents such as water, saline, acetone or ethanol. The oxides of titanium, magnesium, tin and zirconium are preferred metal oxides used in conjunction with rhenium oxide in the mixed-oxide target. The exact ratio of the rhenium oxide to the metal oxide is not narrowly critical, and can vary depending on the metal oxide or hydroxide with which rhenium is combined. Generally, the ratio of rhenium oxide to the metal oxide/hydroxide preferably ranges from about 1:100 to about 2:1 and more preferably from about 1:10 to about 1:1. Without being bound by theory, such a mixed-metal oxide target composition is more porous than a pure rhenium oxide material or a pure rhenium film, and as such, allows for improved recovery of the product nuclide during subsequent separation steps. Mixed oxides containing Re and other metals appeared to yield high radioactivity (typically above 20%) in the supernatant and achieved significant enrichment factors ranging from 2 to 10. (See, for example, Example 3).

The mixed-metal oxide target composition can be prepared, in general, by combining a $^{185}$Re halide such as $ReCl_3$ or $ReCl_5$ with a metal halide such as $TiCl_4$, hydrolyzing the rhenium halide to form the rhenium oxide and hydrolyzing the metal halide to form the metal oxide or metal hydroxide. (See, for example, Example 3). The rhenium chloride and metal chloride can be combined in any suitable manner, including for example combining them as solid powders and subsequently dissolving the powders together into a single solution. Alternatively, solid rhenium chloride can be added to a solution comprising a solvated metal chloride. An another alternative, both the rhenium chloride and the metal chloride can be dissolved independently in different solvents and the two solutions subsequently combined. The hydrolysis of the rhenium and metal chlorides to form the oxides is preferably effected at a pH sufficiently low to avoid oxidizing the reduced form of the rhenium to its +7 oxidation state. Preferably, the pH of the solution is slightly acidic, neutral or slightly basic with the pH maintained at less than about 8. HCl generated during the hydrolysis of the rhenium chloride and the metal chloride can be neutralized by adding a base such as sodium bicarbonate or sodium hydroxide to the solution. After separating the resulting mixed-oxide precipitate from its supernatant, the precipitate is preferably washed in a non-oxidizing solvent such as water, acetone or ethanol to remove any perrhenate formed during the preparation steps, dried with an inert gas purge such as nitrogen, and stored in a desiccator until use. The extent of the drying is not narrowly critical. Without being bound by theory, residual water present in a slightly hydrated mixed-oxide target may provide a source of oxygen for oxidation of rhenium under vacuum conditions and in a low-oxygen atmosphere. However, the level of water may need to be controlled to avoid non-specific oxidation of target nuclides which are not bombarded with neutrons during irradiation.

Regardless of the particular target format which comprises the target nuclide, the targets are preferably aged for at least twenty four hours after drying, and more preferably up to at least 48 hours or longer, including for example up to 96 hours, or one or more weeks. Without being bound by theory, such aging allows the crystalline structure of the metal film to change to a more stable form. The formation of an ultrathin rhenium oxide film may also have an effect on the observed results. Advantageously, thin rhenium films aged for at least 48 hours result generally in more stable irradiated films and in production of $^{186}$Re at higher specific activities. (See, for example, Example 1). The storage conditions are not narrowly critical. The thin film target is preferably stored in a clean, inert desiccator having a drying agent suitable to minimize exposure to water vapor. The desiccator atmosphere can also be purged with an inert gas such as nitrogen or argon. Where the thin metal films are formed on a substrate surface which also constitutes the housing, vial or chamber in which the target nuclide is irradiated, the housing or vial or chamber is preferably sealed under vacuum prior to irradiating. Alternatively, as discussed more fully below, the targets can be irradiated in a chamber adapted to sustain a vacuum during irradiation of the targets.

The target is irradiated with neutrons in the presence of an oxidizing agent to form an irradiated mixture. Preferably, the target is irradiated in an irradiation chamber with thermal neutrons having an energy of less than about 1 eV or with epithermal neutrons having an energy ranging from about 1 eV to about 10 keV. The neutron flux preferably ranges from about $1\times10^{13}$ n/cm$^2$s to about $5\times10^{14}$ n/cm$^2$s. The time of irradiation is not narrowly critical, but is preferably at least about one hour, more preferably at least about 2 hours and most preferably at least about 4 hours. The time of irradiation can range from about one hour to several weeks, and more preferably ranges from about one hour to about one week. In a preferred method, the rhenium thin-film, powdered or mixed-metal oxide target is irradiated with thermal neutrons at a flux ranging from about $2.5\times10^{14}$ n/cm$^2$s to about $4.5\times10^{14}$ n/cm$^2$s for about 1 week. When rhenium target nuclides, $^{t}$Re, are bombarded with neutrons in accordance with the preferred process of the invention, the neutrons are captured by the rhenium nuclides and gamma energy is released to form a rhenium product nuclide, $^{p}$Re, where p is 186 when t is 185 and p is 188 when t is 186.

The oxidizing agent is preferably oxygen, but other known oxidizing agents such as halogens (e.g. chlorine, bromine, iodine) can also be suitably employed. Sulfur-containing oxidizing agents are less preferred. The oxygen (or other oxidizing agents) can be in atomic or molecular form, including for example, molecular oxygen present in the atmosphere surrounding the target nuclide during irradiation and/or atomic oxygen present in the target (e.g. as a rhenium oxide or as a mixed-metal oxide) as an oxygen-containing compound or salt. A mixture of oxidizing agents can also be employed. The activation energy provided from the neutron-capture and gamma-emission/recoil process allows the irradiated target nuclide (which is present in a lower oxidation state) to react with the oxidizing agent to form an oxidized product nuclide. The oxidized product nuclide is, as discussed below, separable from unoxidized product nuclide and/or from unreacted target nuclide based on differences in their oxidation states. In the production of $^{186}$Re or $^{188}$Re, for example, the oxidized product nuclide formed is water-soluble $Re^{+7}$ perrhenate salt.

While the target being irradiated is preferably designed (e.g. as to its surface area, configuration, etc.) in a manner which maximizes the percentage of target nuclides which are bombarded or impinged with a neutron during irradiation, 100% bombardment is not currently commercially practical even at high neutron fluxies, and impingement percentages ranging from about 0.0001% to about 2% are typical. Hence, a substantial number of target nuclides are not bombarded with neutrons during irradiation. Because separation of the oxidized product nuclide is, as discussed below, based on differences in oxidation state of the oxidized product nuclide versus the unreacted target nuclide, it is of fundamental importance to control the oxididation of these non-bombarded target nuclides. Specifically, the non-specific oxidation of a target nuclide which is not reacted with a neutron will result in the formation of an oxidized target nuclide which, unlike unreacted target nuclides, are not separable from the oxidized product nuclide based on differences in oxidation state. Therefore, the rate and/or extent of oxidation of non-bombarded target nuclides is controlled, preferably, by controlling reaction conditions and/or parameters which affect oxidation of non-bombarded target nuclide. The reaction conditions/parameters are controlled to minimize oxididation and, thereby, to achieve enhancement of the desired product nuclide. Such factors include, for example, the amount of oxidizing agent available to participate in an oxidiation reaction during irradiation, the water content of the target being irradiated, and the temperature of the target during irradiation.

More specifically, the amount of oxidizing agent present and available to participate in the oxidation reaction during neutron irradiation is controlled. At a minimum, a stoichiometric amount of oxidizing agent is required, with the stoichiometry being based on the oxidation reaction in which the irradiated target nuclide is oxidized to form the oxidized product nuclide. However, the presence of too much oxidizing agent during irradiation will tend to decrease the specific activity of the resulting product nuclide due to undesired oxidation of non-irradiated target nuclide. Moreover, the amount of oxidizing agent required will vary depending on the flux. At relatively high fluxes, less oxidizing agent is required and/or tolerated in the reaction, whereas at lower fluxes, relatively more oxidizing agent can be tolerated. Hence, it is desirable, in practice, to provide a sufficient amount of oxidizing agent to allow for the formation of oxidized product nuclide from irradiated target nuclide without causing the undesirable formation of oxidized target nuclides from target nuclides which are not bombarded with neutrons. The amount of oxidizing agent present during irradiation and available to participate in the Szilard-Chalmers oxidation reaction ranges, therefore, from a stoichiometric amount (or from a slight stoichiometric excess—≦10%) to an amount which is about a 50% stoichiometric excess, or to an amount which is about a 100% stoichiometric excess, more preferably, to an amount which is about a 400% stoichiometric excess, and most preferably to an amount which is about a 500% stoichiometric excess.

For $^{186}$Re or $^{188}$Re production from elemental rhenium metal ($Re^{o}$—in a zero oxidation state) using oxygen as the oxidizing agent, the amount of oxygen available in the atmosphere over a rhenium thin-film or powder target, and/or in the target or target composition, can be expressed as a ratio relative to the amount of target nuclide atoms present in the target. Assuming a reaction with a Z % conversion of target $Re^{o}$ nuclide to product nuclide and a desired oxygen availability of no stoichiometric excess up to a 400% excess, the mole ratio of oxygen atoms to target nuclide atoms preferably ranges from about 4(Z): 100 (stoichiometric amount) to about 16(Z): 100 (400% stoichiometric excess). For example, for a reaction with a 1/2% conversion of target $Re^{o}$ nuclide to product nuclide, the mole ratio of oxygen atoms to target nuclide atoms preferably ranges from about 1:50 to about 4:50. If a 1% conversion is achieved, the ratio preferably ranges from about 1:25 to about 4:25. If a 2% conversion is achieved, the ratio preferably ranges from about 2:25 to about 8:25. In general, for conversions ranging from about 1/2% to about 2%, the molar ratio of oxygen to target nuclide present in the target ranges from about 1:50 to about 8:25, depending on the percentage of target nuclide being reacted to form product nuclide. Other appropriate ratios can be determined based on the particular stoichiometry for oxidation reactions involving a rhenium target nuclide having an oxidation state ranging from $^{+}3$ to $^{+}6$.

In addition to the amount of oxidizing agent present during irradiation, other reaction conditions and/or parameters should also be controlled to minimize the extent of non-specific oxidation of non-irradiated target nuclide. For example, the irradiation can be effected with the target being under a blanket of inert gas (e.g. argon, nitrogen, etc.). The irradiation can also be effected with the target being in an atmosphere having a pressure which is less than atmospheric pressure. The pressure at which the target is irradiated is preferably less than about 1 mm Hg and more preferably less than about 500 $\mu$m Hg. Irradiation of the rhenium targets in the presence of an inert gas blanket or under vacuum helps inhibit non-selective oxidation of non-irradiated target nuclide, and thereby contributes to enhanced specific activity of the product nuclide. Moreover, non-specific oxidation can be minimized by cooling the target during irradiation to keep the bulk temperature of the irradiated target as low as practical. (Example 1). Such cooling allows for longer periods of irradiation at higher neutron fluxes and helps minimize the non-selective oxidation of unreacted target material. The cooling should be sufficient to effect heat removal at a rate which is sufficient to help reduce the amount of non-irradiated target nuclide which is oxidized, and to thereby improve the specific activity of the resulting product nuclide. Cooling can be effected by any means known in the art, including for example circulating water from the reactor cooling pool past the irradiation housing, vial or chamber. The temperature of the cooling water is not of limiting importance, and can range, for example, from about 30° C. to about 100° C., and preferably from about 30° C. to about 70° C. Other means, including convective flow regimes may also be used to remove some of the heat load generated during irradiation.

After irradiation of the target nuclide to form an irradiated mixture which includes (a) the product nuclide in the relatively higher oxidation state (e.g. for $^{P}$Re production, in the $Re^{+7}$ perrhenate state), and (b) unreacted target nuclide, the oxidized product nuclide is separated from the unreacted target nuclide and recovered as a product mixture which is useful as a radiopharmaceutical. In general, isotopic separation is possible according to the methods herein because (1) after irradiation the radioactive product atoms are in a different oxidation state from the unreacted target atoms, (2) the radioactive atoms do not undergo exchange with stable carrier atoms in the target and (3) the change in oxidation state of the rhenium atom which has captured a neutron does not substantially occur in target nuclides which were not impinged with neutrons. The separation is effected by a protocol that distinguishes between the oxidation state of the oxidized product nuclide and the oxidation state of the unreacted target nuclide.

For the production of $^{186}$Re or $^{188}$Re, the product nuclide, perrhenate, can be separated from unreacted target nuclides by a protocol which includes the step of exposing the target (or at least the portion thereof that contains the oxidized product nuclides) to a non-oxidizing solvent such as water, saline, acetone or ethanol. (See, for example, Example 5). Water or saline are preferred solvents based on availability and biocompatability. The non-oxidizing solvent dissolves and/or leaches the perrhenate into solution, but, importantly, does not oxidize unreacted target nuclide. That is, unreacted target nuclide is not substantially dissolved into solution from the target. However, as some amount of the non-irradiated target nuclide may be nonetheless oxidized as discussed above, a fraction of oxidized target nuclide will also dissolve from the target with the product nuclide. After solubilizing the "hot," water-soluble oxidized $^{186}$ product nuclide, the resulting solution is then filtered to remove insoluble carrier rhenium and to recover the isotopically-enriched target for re-use. The rhenium product nuclide is present in the supernatant as a dissolved perrhenate ion, $ReO_4^-$. Other separation protocols based on differences in oxidation state, now known or later developed, can also be employed.

After separation of the oxidized product nuclide from the unreacted target nuclide, the unreacted target material can be re-used (ie, recycled) for further production of the radionuclide of interest. Intermediate recycled-target preparation steps may be helpful in optimizing subsequent use of the target material.

The recovered product nuclide can be evaluated to verify the source of the activity and to determine its specific activity. (See, for example, Example 6). Recoveries of about 1–20% of the radionuclide produced have been achieved and activities ranging from about 10 mCi to about 100 mCi have been obtained. There are a number of factors involved in the Szilard-Chalmers reaction that determine the radioisotope enhancement, including the thickness of rhenium film (or the particle size of metal or metal-oxide powder), neutron flux, reactor exposure time, gamma irradiation, decay time after the irradiation, and the separation method for the recovery of "hot atoms." As noted above, a primary consideration with regard to enhancement relates to the rate and/or extent of oxidation of non-bombarded target nuclides, as affected by parameters such as the level of oxidizing agent available and temperature during irradiation. Preferably, for irradiations of one hour or greater, the reaction conditions or parameters affecting non-specific oxidation of non-bombarded target nuclides are controlled to produce a product mixture which is isotopically enriched (that is, enhanced) in the product nuclide by an enhancement factor of at least about 1.5 relative to the irradiated mixture. The degree of enrichment for irradiation periods greater than at least about 1 hour is preferably at least about 2, more preferably at least about 3, and most preferably at least about 5. As used herein, isotopic enrichment or enhancement relates to the ratio of the relative amounts of product:target isotopes in the product mixture as compared to the irradiated mixture. Stated analogously, the isotopic enrichment or enhancement relates to the ratio of the fraction of product nuclides in the product mixture (after separation) to the fraction of product nuclides in the irradiated mixture (before separation). For example, if after irradiation, the irradiated mixture contains 2 product nuclides for every 100 target nuclides (2%), and then after the separation step, the product mixture contains 10 product nuclides for every 100 target nuclides (10%), the enrichment or enhancement factor is the ratio of 10/100:2/100 or 5. Determination of enhancement factor is, in practice, typically performed by re-irradiation methods described in detail in Example 6.

The product radionuclides produced according to the present invention are suitable for use in radiopharmaceutical diagnostic and/or therapeutic applications. The inorganic Szilard-Chalmers reaction using rhenium metal film or mixed rhenium oxides as target materials has the potential to provide significantly higher specific activities of (n,γ) $^{186}$Re for radioimmunotherapy and other nuclear medicine applications. Activities up to several millicuries have been produced with the concurrent enhancement of the specific activity of (n,γ) $^{186}$Re and $^{188}$Re. Enhancement factors for $^{186}$Re vs. $^{188}$Re obtained ranged from about 1.5 to about 10. Also of significance, the present invention has allowed for scaling up from 5 second irradiations at $4\times10^{13}$ thermal neutrons per cm$^2$s to 2 hour irradiations at the same flux without significant reduction in the enhancement factor. Enhancement of the specific activity of $^{186}$Re by factors in this range at high neutron flux, are sufficient to render $^{186}$Re a very attractive agent for radioimmunotherapy. The use of inorganic compounds, which in general are more resistant to radiation fields than organic or organometallic compounds, and the simplicity of the process renders it commercially attractive. The inorganic hot atom chemistry could be extended to many different chemical compounds and different isotopes, including in addition to rhenium, compounds of gold, copper, platinum, etc.

The following examples illustrate the principles and advantages of the invention.

EXAMPLES

The following materials were used in the several experiments detailed below: Rhenium metal powders (325 mesh, 99.997% metals basis, Johnson & Matthey), Rhenium(III) chloride (F.W. 292.56, dark red powder, 99.9% metals basis, Johnson & Matthey), Rhenium(V) chloride (F.W. 363.47, dark green powder, 99.9% metals basis, Johnson & Matthey), Rhenium(VII) oxide (light yellow powder, F.W. 484.40, 99.99% metals basis, Johnson & Matthey), Rhenium silicide ($ReSi_2$, F.W. 242.37, ~80 mesh powder, 99.9% metals basis, Johnson & Matthey), Rhenium (VI) oxide ($ReO_3$, F.W. 236.20, purplish red powder, Johnson & Matthey), Rhenium (IV) oxide ($ReO_2$, F.W. 218.24, black powder, 99.9% metals basis, Johnson & Matthey), Rhenium foil (0.25 mm thick, 99.98%, F.W. 186.20, Aldrich Chemical). Rhenium(VII) sulfide, (Re 60.6%, $Re_2S_7.H_2O$, F.W. 614.87, black powder, Johnson & Matthey), Acetone (2-propanone, >99.5%, Fisher), Magnesium chloride ($MgCl_2.6H_2O$, Mallinckrodt), Sodium hydroxide solution (4.95–5.05N, standard solution, Fisher), Tin (II) chloride (Stannous chloride $SnCl_2$, F.W. 189.60, 99.99+%, Aldrich Chemical), Titanium (IV) chloride ($TiCl_4$, F.W. 189.71, liquid, 99.8% metals basis, Johnson & Matthey).

In the experiments, the rhenium targets were prepared as thin film elemental rhenium, as powdered elemental rhenium and as mixed rhenium oxide compositions. The targets were irradiated with thermal neutrons at a flux ranging from about $4\times10^{13}$ neutrons/cm$^2$·s to about $4–8\times10^{13}$ neutrons/cm$^2$·s for times varying from 10 minutes to 15 hours. For irradiation times less than 1 hour, samples were placed in high purity polyethylene vials and sealed at 1 atm. These vials were then placed in a polypropylene capsule which was inserted into the reflector positions through a pneumatic tube system. For irradiation times greater than 1 hour, samples were sealed in high purity quartz vials which were then encapsulated in aluminum capsules/cans. Irradiations using a water-flooded aluminum can were also performed to minimize the excessive heating during the neutron bombardment. Quartz vials were in direct contact with cooling water circulating through the holes on the aluminum wall. The temperature of quartz vials in flooded irradiation can were maintained lower than 100° C., typically around 70° C.

After irradiation, the product nuclides were separated from the target nuclide and the enrichment factors were determined by reirradiation methods. The several examples demonstrate that the use of rhenium metal (thin film or powder), mixed rhenium oxide/metal oxide compositions, and other reduced oxidation state rhenium compounds (e.g rhenium sulfide) as target materials in this type of Szilard-Chalmers reaction results in enhanced specific activity of $^{186}$Re and $^{188}$Re.

Example 1

Rhenium Metal Films

A rhenium metal target was prepared that deposited as a mirror on the surface of quartz by vaporizing rhenium chloride in an open quartz container over a Bunsen burner. Briefly, about 0.1–1 mg Rhenium Trioxide or Rhenium Pentoxide were weighed in a high purity quartz tube with one end sealed. The open end of this quartz tube containing rhenium chloride was inserted into a Teflon tube which was connected to a vacuum pump. A carbon capsule (Gelman Sciences, containing activated charcoal particles) was installed in the vacuum line to remove the organics, volatile rhenium chlorides, water and other chemicals that may potentially be collected into the system. After the vacuum pump was turned on for several minutes, the quartz tube was placed on the flame of a Bunsen burner, and a thin layer of shiny metal film was soon produced on the quartz wall. The quartz tube coated with a thin layer of silvery rhenium metal was then rinsed with water and acetone (to remove the residual rhenium chloride and soluble perrhenate) and vacuum dried. The tube was then sealed with or without vacuum using a torch.

The thickness of a rhenium metal film target was estimated as follows. Rhenium was coated on the quartz wall over an area of about 0.5 $cm^2$ and encapsulated in a high purity quartz vial. The target was irradiated for 60 minutes using a thermal neutron flux of $4\times10^{13}$ $n/cm^2s$. The irradiated target had a total activity of 22.1 $\mu$Ci (AtomLab Dose Calibrator, $^{186}$Re setting). The mass of the rhenium metal present in the target, based on the activity, irradiation time and flux was 15 $\mu$g. Based on the density of rhenium metal (20.53 $g/cm^3$) and the area of the rhenium film, the thickness of film was 15 nm (150 Å). Based on the atomic radius of Re (1.28 Å), a 15 nm thickness represents about ~59 Re atoms.

The amount of chlorine present in the Re metal film was analyzed by irradiating quartz pieces containing a Re metal film made from $ReCl_3$ (heat decomposition) for 5 seconds in a P-tube. Results are shown in Table 1.

TABLE 1

Chlorine Analysis in Re Metal Film

| C1-38 Peak at 1642 keV | | C1-38 Peak at 2168 keV | |
|---|---|---|---|
| Sample | 1.75 cps | Sample | 1.86 cps |
| Blank | 1.32 cps | Blank | 1.15 cps |

The quartz tube coated with a thin layer of silvery rhenium metal was then sealed and irradiated for 60 minutes or longer at irradiation positions with the thermal neutron flux of $3\times10^{13}$ $n/cm^2s$ or higher from 60 seconds up to three hours. De-ionized water was used to elute the recoil hot atoms (in perrhenate form) from the target and the activity recovered in the water ranged from 5–100%.

Data from the production of $^{186}$Re in a reactor with a thermal neutron flux 3–$7\times10^{13}$ $n/cm^2s$ is plotted in FIG. 1, with the results from specific experiments detailed below.

Experiment 1.1

A Re metal film target was prepared by heat decomposition of $ReCl_3$ in quartz vial and encapsulated in a quartz vial at 1 atm. The unaged target was irradiated for 1 hour at $3\times10^{13}$ $n/cm^2s$. About 44% of the total activity was recovered in water (assayed with AtomLab Dose Calibrator with $^{188}$Re setting). The recovered radionuclide was reirradiated (1 hour at $3\times10^{13}$ $n/cm^2s$) to determine the enrichment factor for $^{186}$Re=1.76 and for $^{188}$Re=2.46.

Experiment 1.2

A Re metal film target was prepared by heat decomposition of $ReCl_3$ in quartz vial and encapsulated in a quartz vial without vacuum. The target was irradiated for 2 hours at $3\times10^{13}$ $n/cm^2s$. The entire rhenium film dissolved in water during the separation protocol.

Experiment 1.3

A Re metal film made from $ReCl_3$ (heat decomposition) target was aged for 48 hours in an evacuated container and encapsulated in a high purity quartz vial and sealed under vacuum. The target was irradiated for 1 hour at $4\times10^{13}$ $n/cm^2s$. About 20% of the radioactivity as $^{188}$Re was recovered in water. The enrichment factor based on reirradiation of the recovered Re (1 hour at $4\times10^{13}$ $n/cm^2s$) was for $^{186}$Re=3.65 and for $^{188}$Re=3.00.

Experiment 1.4

A Re metal film made from $ReCl_3$ (heat decomposition) target was aged for 48 hours in desiccator and encapsulated in a high purity quartz vial and sealed at 1 atm. The target was irradiated for 1 hour at $4\times10^{13}$ $n/cm^2s$. About 34.3% of the activity as $^{188}$Re was recovered in water. Reirradiation of the recovered Re (1 hour at $4\times10^{13}$ $n/cm^2s$) showed an enrichment factor for $^{186}$Re=2.06 and for $^{188}$Re=2.09.

Experiment 1.5

A Re metal film target made from $ReCl_3$ (heat decomposition), target was aged for four weeks in a desiccator and encapsulated in a high purity quartz vial and sealed under vacuum. The target was irradiated for 2 hours at $8\times10^{13}$ $n/cm^2s$. The target was cooled during irradiation by housing the vial in a flooded aluminum can through which reactor cooling pool water was circulated. About 15% of the activity as $^{188}$Re was recovered in water. Reirradiation of the recovered Re (1 hour at $4\times10^{13}$ $n/cm^2s$ (p-tube)) showed an enrichment for $^{186}$Re=3.24 and for $^{188}$Re=3.17.

Example 2

Rhenium Metal Powder

A Re metal powder target, 325 mesh (~45 mm in diameter) was encapsulated in a high purity quartz vial without vacuum. The target was irradiated for 1 hour at $4\times10^{13}$ $n/cm^2s$. 9.8% as $^{188}$Re was recovered in water. Reirradiation of the recovered Re (1 hour at $4\times10^{13}$ $n/cm^2s$) showed an enrichment for $^{186}$Re=1.75 and for $^{188}$Re=1.93.

Example 3

Mixed Rhenium Oxides/Metal Oxides

Target compositions comprising mixtures of rhenium oxides and metal oxides were prepared as detailed prepared as detailed below. The physical appearance of the various rhenium oxides are shown in Table 2.

TABLE 2

Mixed Rhenium Oxides/Metal Oxides

| Compounds | Physical Appearance |
|---|---|
| $ReO_2$ | powder, black |
| $ReO_3$ | powder, dark red |
| $ReO_3.xH_2O$-$MgO.yH_2O$ | powder, purple |
| $ReO_3.xH_2O$-$TiO_2.yH_2O$ | powder, green |
| $ReO_2.xH_2O$-$SnO_2.yH_2O$ | powder, brown |
| $Re_2S_7.H_2O$ | powder, dark brown |
| $ReSi_2$ | powder, black |

In the following experiments, irradiations for time periods of 30 minutes or less were generally performed without cooling on samples which were at atmospheric pressure. Irradiations for longer periods were generally performed on samples sealed under vacuum and which were cooled during irradiation.

Experiment 3.1: Rhenium Oxides and Titanium Oxides

A sample of mixed rhenium oxide and titanium oxide target composition was prepared by mixing rhenium trichloride and titanium tetrachloride and co-precipitating the mixed metal chlorides in basic solution. Briefly, about 1–5 mg of Rhenium Trichloride or Rhenium Pentachloride were placed in a dry reaction vial containing a magnetic stir bar. In the fume hood, 0.5 ml of $TiCl_4$ (colorless liquid form, fuming and volatile) was added into the vial by pipette. The Re chloride dissolved with stirring in the $TiCl_4$ and the solution turned to a purple color. About 10 ml of $Na_2CO_3$ (mixed with 0.5N NaOH) solution with pH>10 was slowly added into the $TiCl_4$ solution; white fumes (presumably HCl) were released from the solution, and a precipitate of mixed hydrous $TiO_2$ and $ReO_2/ReO_3$ was immediately observed. The precipitate was separated from the supernatant through centrifugation, washed with de-ionized water and acetone, dried with nitrogen gas, and stored in a desiccator.

This rhenium oxide/titanium oxide target composition was irradiated at $4\times10^{13}$ n/cm$^2$s for 60 seconds. The radioactive mixture containing $^{188}$Re and $^{186}$Re was washed with DI water, and about 77% of activity (assayed with AtomLab Dose Calibrator with $^{188}$Re setting) was obtained in the aqueous solution. The re-irradiation of the radioactive wash one week later produced less radioactivity by a factor of 10.3 for both $^{188}$Re and $^{186}$Re, corresponding to a 10.3-fold isotopic enrichment.

In another experiment, a quartz ampoule containing about 8 mg of dark purple colored Re-Ti oxides was irradiated at $8\times10^{13}$ n/cm$^2$s for 15 hours. About 300 mCi of $^{186}$Re was produced and 85.5% of this activity was recovered in water. The re-irradiation of a fraction of the supernatant indicated that enrichment factors for $^{186}$Re and $^{188}$Re were 1.5 and 1.67 respectively.

Experiment 3.2: Rhenium and Tin Oxides

A target composition comprising rhenium oxides and tin oxides was prepared, briefly, by dissolving about 1 mg of $Re_2O_7$ was in 2–3 ml of water and adding to this solution 2–3 ml of stannous chloride solution containing about 2–3 mg of $SnCl_2$. The solution was stirred and heated to ~90° C. for 20 minutes and the dark mixture of Re(IV) and Tin (IV) oxides were formed. The solid precipitate was then collected in a clean test tube after separation from the supernatant, washed with water and acetone, dried with nitrogen gas, and stored in a desiccator.

About 1 mg of $ReO_2/SnO_2$ (1:1 ratio) mixture was irradiated at a thermal neutron flux of $4\times10^{13}$ n/cm$^2$s for 30 minutes. The irradiated sample was washed with 5 ml de-ionized water and 23.3% of the activity was collected in the water. Enrichment factors obtained from the second irradiation of the water sample were: 2.09 for $^{186}$Re; and 2.00 for $^{188}$Re.

In another experiment, about 1 mg of $ReO_2/SnO_2$ (1:2 ratio) mixture was prepared and irradiated at $4\times10^{13}$ n/cm$^2$s for one 1 hour. The sample containing 1.1 mCi of radioactivity (assayed with AtomLab Dose Calibrator at $^{188}$Re setting) was washed with 5 ml of acetone and 46.7% of the activity was recovered in acetone. Enrichment factors obtained from the subsequent irradiation of solvent aliquots were 3.34 for $^{186}$Re; and 5.02 for $^{188}$Re.

Experiment 3.3: Rhenium and Magnesium Oxides

A target composition comprising rhenium oxides and magnesium oxides were prepared as follows. To a sodium carbonate buffer solution at pH=~11, solutions of $ReCl_3$ in acetone and $MgCl_2$ in water were slowly added through two pipettes. Vigorous stirring was maintained during the addition of the solutions and the formation of purple-colored colloidal Re and Mg oxides. The ratio of Re/Mg was normally kept 1:10.

The mixed oxide composition was irradiated in the reactor at $4\times10^{13}$ n/cm$^2$s for 1 minute. About 80% of the activity, (80 $\mu$Ci of $^{188}$Re and 17 $\mu$Ci of $^{186}$Re) was washed off the irradiated mixture with 10 ml of acetone. After the radioactivity of $^{186}$Re and $^{188}$Re had decayed away, the dried acetone residue was re-irradiated in the reactor for one minute, producing 41 $\mu$Ci of $^{188}$Re and 8 $\mu$Ci of $^{186}$Re. Thus a two fold radioisotopic enrichment was obtained.

The experiment using this preparation was scaled-up to a 30 minute irradiation at the same neutron flux. About 2 mg of mixed oxides were irradiated for 30 minutes and about 4.6 mCi of $^{188}$Re (assayed with AtomLab Dose Calibrator) was produced. The target was washed three times with de-ionized water, 0.5 ml, 1.5 ml, and 1.5 ml respectively. Total activity in the three washes (3.5 ml of water) was 3.8 mCi, representing 81.7% recovery. Three aliquots (150 ul each) were taken from the radioactive supernatant samples and their activities before and after second irradiation were measured. The $^{186}$Re and $^{188}$Re enrichment factors obtained from the three samples ranged from 2.73 to 4.71, as determined from the data shown in Table 3.

TABLE 3

Re-Mg Oxides (2 mg, 30 min irradiation)

| Sample/Isotope (150 $\mu$l) | First Irrad. ($\mu$Ci) | Second Irrad. ($\mu$Ci) | Enrichment Factor |
|---|---|---|---|
| I $^{186}$Re | 45.26 | 10.02 | 4.52 |
| I $^{188}$Re | 224.10 | 71.36 | 3.14 |
| II $^{186}$Re | 35.72 | 7.58 | 4.71 |
| II $^{188}$Re | 171.16 | 60.2 | 2.84 |
| III $^{186}$Re | 6.91 | 1.79 | 3.86 |
| III $^{188}$Re | 34.03 | 12.45 | 2.73 |

Experiment 3.4: Various Mixed Oxides (60 sec Irradiation)

Five different rhenium mixed oxide samples were prepared and irradiated at $4\times10^{13}$ n/cm$^2$s for 60 seconds. The results are shown in Table 4.

TABLE 4

Various Mixed Oxides (60 sec Irradiation)

| Sample | Mass (mg) | Color Starting Material |
|---|---|---|
| A1 | 3.5 | purple $ReCl_5 + MgCl_2$ |
| A2 | 2.8 | gray/light green $ReCl_3 + MgCl_2$ |
| B1 | 11 | gray/light purple $ReCl_5 + TiCl_4$ |
| B2 | 6.9 | gray $ReCl_3 + TiCl_4$ |
| G | 14.8 | green $ReCl_5 + TiO_2$ |

| Sample | Activity ($\mu$Ci) total/supernatant/target | % Recovery |
|---|---|---|
| A1 | 134.8/82.0/54.5 | 60.8% |
| A2 | 75.5/54.0/17.4 | 71.5% |
| B1 | 72.8/56.3/23.4 | 77.3% |
| B2 | 80.9/48.9/32.7 | 60.4% |
| G | 28.6/ 4.0/25.0 | 14.0% |

| Sample | First Irrad. $^{188}$Re ($\mu$Ci) | Second Irrad. $^{188}$Re ($\mu$Ci) | Enrichment Factor $^{188}$Re |
|---|---|---|---|
| A1 | 90.78 | 12.04 | 7.54 |
| A2 | 66.25 | 15.63 | 4.23 |
| B1 | 15.49 | 3.30 | 4.69 |
| B2 | 9.40 | 2.55 | 3.68 |
| G | 2.75 | 2.13 | 1.29 |

Example 4

Rhenium Sulfide

Hydrated rhenium sulfide targets ($Re_2S\cdot7H_2O$) were irradiated in two experiments.

In a first experiment, 0.95 mg of hydrated rhenium sulfide was irradiated with thermal neutrons at $4\times10^{13}$ n/cm$^2$s for 10 minutes. About 495 $\mu$Ci were produced, as assayed with AtomLab Dose Calibrator. About 12.4% of the activity was recovered by flushing with de-ionized water (5 ml). The resulting enrichment was, for $^{186}$Re=4.06, and for $^{188}$Re=3.88.

In a second experiment, 1 mg of hydrated rhenium sulfide was irradiated with thermal neutrons at $4\times10^{13}$ n/cm$^2$s for 20 minutes. About ~1 mCi were produced as assayed with AtomLab Dose Calibrator. The recovery was about 41.8% using an acetone solvent (5 ml). The resulting enrichment was for $^{186}$Re=1.48, and for $^{188}$Re=1.88.

Example 5

Recovery of $^{186}$Re and $^{188}$Re

The irradiated rhenium targets were allowed to decay for 1 to 12 hours to minimize short-lived by-product radionuclides. The irradiation capsule (quartz ampoule or polyethylene vial) was then opened using a vial breaker or a razor. De-ionized water or organic solvents such as acetone and absolute ethanol were added to the rhenium target and the suspension mixed using a vortex device. After one or two minutes, the supernatant was separated from solid target by filtration. The radioactivity in the solvent and radioactivity remaining in the target and filter were measured using an AtomLab Dose Calibrator adjusted to the $^{188}$Re setting. Aliquots of supernatant were taken and analyzed with a high resolution, high purity intrinsic Ge detector.

Example 6

Determination of Enrichment Factors

A fraction of supernatant containing $^{186}$Re and $^{188}$Re obtained from the above procedure was then transferred into a clean polyethylene vial, and the solvent in the vial was carefully taken to dryness under a heat lamp. The vial was then heat sealed and the radioactivity of $^{186}$Re and $^{188}$Re was measured with a Ge detector and recorded as A1. A1 was decay corrected to EOI of the first irradiation as A01. After most of the activity in the vial decayed away, the vial was irradiated at the same position for the same exposure time as the first irradiation.

The radioactivity produced from the second irradiation was then measured with a Ge detector and recorded as A2. After A2 was converted to A02 (the activity of EOI of second irradiation), A02 was compared with A01 and the enrichment factor is calculated as follows: Enrichment Factor=A01/A02. If the second irradiation produces the same amount of activity as the first irradiation, that is, A02=A01, there is no radioisotope enrichment, since it requires the same number of cold rhenium atoms in the recovered sample to produce the same amount of activity. On the other hand, if A02<A01, there is less cold rhenium (carrier) to be activated to radioactive rhenium isotopes, hence the specific activity of radioactive rhenium is enhanced, and thus there is a radioisotope enrichment.

In light of the detailed description of the invention and the examples presented above, it can be appreciated that the several objects of the invention are achieved. The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the invention.

We claim:

1. A method for producing a radionuclide via a (n,γ) Szilard-Chalmers reaction, the method comprising irradiating a target with neutrons in the presence of an oxidizing agent to form an irradiated mixture, the target comprising a metal target nuclide in the form of a metallic element or an inorganic metallic compound or salt, the irradiated mixture comprising (a) an oxidized product nuclide formed by reaction of the target nuclide with neutrons via a (n,γ) reaction and with the oxidizing agent via an oxidation reaction, and (b) unreacted target nuclide which has not reacted with a neutron or with the oxidizing agent, controlling oxidation of target nuclide which has not reacted with a neutron, and separating the oxidized product nuclide from unreacted target nuclide.

2. The method of claim 1 wherein the target comprises elemental rhenium or an inorganic rhenium compound or salt which includes a $^{t}$Re target nuclide in an oxidation state of not more than +6, where t is 185 or 187, and the oxidized product nuclide is $^{p}ReO_4^-$, where p is 186 when t is 185 and p is 188 when t is 187.

3. The method of claim 1 wherein the target consists essentially of elemental rhenium.

4. The method of claim 1 wherein the target comprises an inorganic rhenium compound or a salt thereof which includes a $^{t}$Re target nuclide in an oxidation state of not more than +6.

5. The method of claim 1 wherein the target comprises a rhenium oxide or a salt thereof which includes a $^{t}$Re target nuclide in an oxidation state of not more than +6.

6. The method of claim 1 wherein the target comprises a rhenium oxide or a salt thereof which includes a $^{t}$Re target nuclide in an oxidation state of not more than +6, and either or both of a M-oxide or a M-hydroxide where M is a metal other than rhenium.

7. The method of claim 6 wherein M is selected from the group of metals consisting of tin, titanium and magnesium.

8. The method of claim 1 wherein the oxidizing agent is oxygen.

9. The method of claim 1 wherein oxidation of target nuclide which has not reacted with a neutron is controlled by controlling the amount of oxidizing agent available to react with the target nuclide.

10. The method of claim 1 wherein oxidation of target nuclide which has not reacted with a neutron is controlled by controlling the temperature of the target during irradiation.

11. The method of claim 1 wherein the oxidized product nuclide is separated from unreacted target nuclide by a protocol that includes exposing the oxidized product nuclide to a non-oxidizing solvent.

12. A method for producing a radionuclide via a (n,γ) Szilard-Chalmers reaction, the method comprising irradiating a target with neutrons in the presence of an oxidizing agent to form an irradiated mixture, the target comprising a metal target nuclide in the form of a metallic element or an inorganic metallic compound or salt, the irradiated mixture comprising (a) an oxidized product nuclide formed by reaction of the target nuclide with the neutrons and with the oxidizing agent and (b) unreacted target nuclide which has not reacted with a neutron or with the oxidizing agent, the amount of oxidizing agent present during irradiation ranging from a stoichiometric amount to about four times the stoichiometric amount required for the target nuclide to react with the oxidizing agent to form the oxidized product nuclide, and separating the oxidized product nuclide from unreacted target nuclide.

13. The method of claim 12 wherein the target comprises elemental rhenium or an inorganic rhenium compound or salt which includes a $^{t}$Re target nuclide in an oxidation state of not more than +6, where t is 185 or 187, and the oxidized product nuclide is $^{p}ReO_4^-$, where p is 186 when t is 185 and p is 188 when t is 187.

14. A method for producing a radionuclide via a (n,γ) Szilard-Chalmers reaction, the method comprising irradiating a target with neutrons at a pressure which is less than atmospheric pressure and in the presence of an oxidizing agent to form an irradiated mixture, the target comprising a metal target nuclide in the form of a metallic element or an inorganic metallic compound or salt, the irradiated mixture comprising (a) an oxidized product nuclide formed by reaction of the target nuclide with the neutrons and with the oxidizing agent, and (b) unreacted target nuclide which has not reacted with a neutron or with the oxidizing agent, separating the oxidized product nuclide from unreacted target nuclide.

15. The method of claim 14 wherein the target comprises elemental rhenium or an inorganic rhenium compound or salt which includes a $^{t}$Re target nuclide in an oxidation state of not more than +6, where t is 185 or 187, and the oxidized product nuclide is $^{p}ReO_4^-$, where p is 186 when t is 185 and p is 188 when t is 187.

16. The method of claim 14 wherein the target is irradiated at a pressure which is less than about 1 mm Hg.

17. A method for producing a radionuclide via a (n,γ) Szilard-Chalmers reaction, the method comprising irradiating a target with neutrons in the presence of an oxidizing agent to form an irradiated mixture, the target comprising a metal target nuclide in the form of a metallic element or an inorganic metallic compound or salt, the irradiated mixture comprising (a) an oxidized product nuclide formed by reaction of the target nuclide with the neutrons and with the oxidizing agent and (b) unreacted target nuclide which has not reacted with a neutron or with the oxidizing agent, cooling the target while the target is being irradiated, and separating the oxidized product nuclide from unreacted target nuclide.

18. The method of claim 17 wherein the target comprises elemental rhenium or an inorganic rhenium compound or salt which includes a $^{t}$Re target nuclide in an oxidation state of not more than +6, where t is 185 or 187, and the oxidized product nuclide is $^{p}ReO_4^-$, where p is 186 when t is 185 and p is 188 when t is 187.

19. The method of claim 17 wherein the target is cooled by contacting the target or a housing enclosing the target with a circulating fluid having a temperature, before contacting the target or housing, of not more than about 100° C.

20. A method for producing a radionuclide via a (n,γ) Szilard-Chalmers reaction, the method comprising irradiating a target with neutrons in the presence of an oxidizing agent to form an irradiated mixture, the target comprising a metal target nuclide present in a target layer formed on the surface of a substrate, the target layer comprising a metallic element or an inorganic metallic compound or salt and having a projected thickness of not more than about 150 nm, the irradiated mixture comprising (a) an oxidized product nuclide formed by reaction of the metal target nuclide with the neutrons and with the oxidizing agent, and (b) unreacted target nuclide which has not reacted with a neutron or with the oxidizing agent, separating the oxidized product nuclide from unreacted target nuclide by a protocol which includes the step of exposing the oxidized product nuclides to a non-oxidizing solvent.

21. The method of claim 20 wherein the target comprises elemental rhenium or an inorganic rhenium compound or salt which includes a $^{t}$Re target nuclide in an oxidation state of not more than +6, where t is 185 or 187, and the oxidized product nuclide is $^{p}ReO_4^-$, where p is 186 when t is 185 and p is 188 when t is 187.

22. The method of claim 20 wherein the projected thickness of the target layer is not more than about 15 nm.

23. A method for producing a radionuclide via a (n,γ) Szilard-Chalmers reaction, the method comprising preparing a target comprising a metal target nuclide in the form of a metallic element or an inorganic metallic compound or salt, allowing the prepared target to age for at least about 24 hours, irradiating the aged target with neutrons in the presence of an oxidizing agent to form an irradiated mixture, the irradiated mixture comprising (a) an oxidized product nuclide formed by reaction of the target nuclide with the neutrons and with the oxidizing agent, and (b) unreacted target nuclide which has not reacted with a neutron or with the oxidizing agent, and separating the oxidized product nuclide from unreacted target nuclide.

24. The method of claim 23 wherein the target comprises elemental rhenium or an inorganic rhenium compound or salt which includes a $^{t}$Re target nuclide in an oxidation state of not more than +6, where t is 185 or 187, and the oxidized product nuclide is $^{p}ReO_4^-$, where p is 186 when t is 185 and p is 188 when t is 187.

25. The method of claim 23 wherein the prepared target is allowed to age for at least about 48 hours before being irradiated.

26. The method of claim 23 wherein the prepared target is allowed to age for at least about one week before being irradiated.

27. A method for producing $^{186}$Re or $^{188}$Re via a (n,γ) Szilard-Chalmers reaction, the method comprising preparing a target comprising a rhenium target nuclide, $^{t}$Re, having an oxidation state of not more than $^{+}$6 in the form of elemental rhenium or an inorganic rhenium compound or salt, where t is 185 for producing $^{186}$Re and t is 187 for producing $^{188}$Re, allowing the prepared target to age for at least about 24 hours, irradiating the aged target with neutrons at a pressure which is less than atmospheric pressure and in the presence of an oxidizing agent for at least about 1 hour to form an irradiated mixture, the irradiated mixture comprising (a) an oxidized product nuclide, $^{p}$Re, formed by reaction of $^{t}$Re with neutrons via a (n,γ) reaction and with the oxidizing agent via an oxidation reaction, where p is 186 when t is 185 and where p is 188 when t is 187, and (b) unreacted target nuclide which has not reacted with a neutron or with the oxidizing agent, cooling the target while the target is being irradiated, and separating the oxidized product nuclide from unreacted target nuclide to form a product mixture, the product mixture being isotopically enriched in the product nuclide by a factor of at least about 1.5 relative to the irradiated mixture.

28. The method of claim 27 wherein the product mixture is isotopically enriched in the product nuclide by a factor of at least about 3 relative to the irradiated mixture.

29. The method of claim 1 wherein the oxidizing agent is molecular oxygen present in an atmosphere surrounding the target.

30. The method of claim 1 wherein the oxidizing agent is atomic oxygen present in the target.

31. The method of claim 30 wherein the target comprises a rhenium oxide or a salt thereof which includes a $^{185}$Re or $^{187}$Re target nuclide in an oxidation state of not more than +6, and a M-oxide, where M is a metal other than rhenium.

32. The method of claim 31 wherein M is magnesium.

33. The method of claim 31 wherein M is tin.

34. The method of claim 31 wherein M is titanium.

35. The method of claim 30 wherein the target comprises a rhenium oxide or a salt thereof which includes a $^{185}$Re or $^{187}$Re target nuclide in an oxidation state of not more than +6, and a M-hydroxide where M is a metal other than rhenium.

36. The method of claim 35 wherein M is magnesium.

37. The method of claim 35 wherein M is tin.

38. The method of claim 35 wherein M is titanium.

39. The method of claim 12 wherein the oxidizing agent is atomic oxygen present in the target.

40. The method of claim 39 wherein the target comprises a rhenium oxide or a salt thereof which includes a $^{185}$Re or $^{187}$Re target nuclide in an oxidation state of not more than +6, and a M-oxide, where M is a metal other than rhenium.

41. The method of claim 40 wherein M is magnesium.

42. The method of claim 17 wherein the oxidizing agent is atomic oxygen present in the target.

43. The method of claim 20 wherein the oxidizing agent is atomic oxygen present in the target.

44. The method of claim 23 wherein the oxidizing agent is atomic oxygen present in the target.

45. The method of claim 27 wherein the oxidizing agent is atomic oxygen present in the target.

* * * * *